US006136049A

United States Patent [19]

Nakajima et al.

[11] Patent Number: 6,136,049

[45] Date of Patent: Oct. 24, 2000

[54] DIESEL FUEL OIL COMPOSITION

[75] Inventors: Isao Nakajima, Saitama; Takashi Hino, Tokorozawa, both of Japan

[73] Assignee: Tonen Corporation, Saitama, Japan

[21] Appl. No.: 09/307,329

[22] Filed: May 7, 1999

[30] Foreign Application Priority Data

May 15, 1998 [JP] Japan ..... 10-152033

[51] Int. Cl.[7] ..... C10L 1/10

[52] U.S. Cl. ..... 44/393; 44/400; 44/406; 208/15

[58] Field of Search ..... 44/393, 400, 406; 208/15

[56] References Cited

U.S. PATENT DOCUMENTS

| | | | |
|---|---|---|---|
| 2,917,375 | 12/1959 | Hudson . | |
| 3,444,082 | 5/1969 | Kautsky . | |
| 3,982,909 | 9/1976 | Hollyday, Jr. . | |
| 3,997,456 | 12/1976 | Voss et al. | 252/62.1 |
| 4,210,424 | 7/1980 | Feldman et al. | 44/62 |

FOREIGN PATENT DOCUMENTS

| | | | |
|---|---|---|---|
| 0255345 | 2/1988 | European Pat. Off. | C10L 1/14 |
| 0301837 | 2/1989 | European Pat. Off. | C10L 1/14 |
| 0308176 | 3/1989 | European Pat. Off. | C10L 1/14 |
| 149866 | 8/1981 | Germany . | |
| 19700159 | 7/1998 | Germany | C08L 61/06 |
| 57-207696 | 12/1982 | Japan | C10L 1/14 |
| 07331261 | 12/1995 | Japan | C10L 1/18 |
| 08157839 | 6/1996 | Japan | C10L 1/04 |
| 08291292 | 11/1996 | Japan | C10L 1/22 |
| 11071586 | 3/1999 | Japan | C10L 1/08 |
| 11035953 | 9/1999 | Japan | C10L 1/08 |
| 11241078 | 9/1999 | Japan | C10L 1/16 |
| 1264638 | 2/1972 | United Kingdom | C10L 1/04 |
| 1264684 | 2/1972 | United Kingdom | C10L 1/04 |
| 1266037 | 3/1972 | United Kingdom | C10L 1/16 |
| 1469016 | 3/1977 | United Kingdom | C10L 1/18 |

*Primary Examiner*—Margaret Medley
*Attorney, Agent, or Firm*—Joseph J. Allocca

[57] ABSTRACT

The present invention provides diesel fuel oil composition comprising a base fuel which contains normal paraffin compounds having a carbon number of 20 or more 4.0 wt % or less, has a specific carbon number distribution in the high-boiling normal paraffin compounds, contains sulfur at 0.05 wt % or less, and is incorporated with 0.01 to 0.1 wt % of a FI.

3 Claims, No Drawings

DIESEL FUEL OIL COMPOSITION

DETAILED DESCRIPTION OF THE PRESENT INVENTION

1. Field of Industrial Utilization

This invention relates to a new diesel fuel oil composition, more particularly the composition characterized by base fuel which contains a specific content of normal paraffin compounds having a carbon number of 20 or more, has a specific carbon number distribution in the high-boiling normal paraffin compounds, and is incorporated with a flow improver (FI).

2. Prior Art

Diesel engines are widely used for various purposes, e.g., for driving automobiles, ships and construction machines, and are still spreading further. As a result, fuel for diesel engines is increasingly in demand, and becoming heavier to satisfy the increased demands, because straight-run diesel fuel oil is distilled deeper and/or blended with heavier fractions. This is accompanied by several problems, e.g., deteriorated fluidity at low temperature (i.e., increased pour point and/or cold flow plugging point). It is anticipated, therefore, that several engine troubles, e.g., plugging of fuel passage or fuel filter, may occur regionally in a normal temperature range at which the engine is operated in some districts.

Several measures against deteriorated fluidity of diesel fuel oils at low temperature have been proposed to provide fuel oils having adequate pour point and cold flow plugging point (CFPP) properties for temperature conditions, in particular in cold districts. These measures include limitation on end point of straight-run diesel oil, limitation on use of heavier fractions as the blending stocks, use of lighter blending stocks, and use of adequate additives, e.g., fluidity improver, including pour point depressant and FI, to improve fluidity at low temperature. For example, Japanese Laid-open Patent application No. 8-157839 discloses fuel oil composition characterized by base fuel which contains normal paraffin compounds at 15 wt % or less, normal paraffin compounds having a carbon number of 20 or more at 1.2 wt % or less, and sulfur at 0.15 wt % or less, as the composition serviceable in cold districts, high in density, sufficiently low in pour point and allowing the engine to produce a high power.

Japanese Laid-open Patent application No. 7-331261 discloses a diesel fuel oil composition composed of diesel oil having an end point in a range from 320° C. to 340° C., incorporated with 0.1 to 2.0 vol % of a fraction containing normal paraffin compounds having a carbon number of 26 to 31 and 100 to 600 ppm of an ethylene vinyl acetate-based additive to improve fluidity at low temperature. This composition is aimed at abatement of particulate emissions from a diesel engine and improvement of low-temperature fluidity, measured by CFPP.

Limitation on end point of straight-run diesel oil and limitation on use of heavier fractions as the blending stocks to secure low-temperature fluidity of diesel fuel oils provide a good pour point, but are difficult to provide a good CFPP. Moreover, these approaches contribute little to increasing diesel fuel oil supplies. Blending diesel fuel oil with a lighter fraction decreases flash point and also decreases engine output. Use of an additive, such as pour point depressant or FI, involves some problems. For example, a pour point depressant, although decreasing pour point, will not decrease CFPP. A FI, on the other hand, although generally decreasing pour point and CFPP, may not efficiently decrease CFPP, depending on type of stock for base fuel which constitutes diesel fuel oil or distillation properties of base fuel.

It is an object of the present invention to provide a diesel fuel oil composition showing good CFPP by improving the prior-art techniques.

DESCRIPTION OF THE INVENTION

It has been discovered that good CFPP can be secured when the base fuel satisfies the relationships of $0<A\leqq 4.00$ (wt %) (wherein, A is content, based on all normal paraffin compounds present in the base fuel, of normal paraffin compounds having a carbon number of 20 or more), and $0.04\leqq[B/C]\leqq 0.40$ (wherein, B is content of normal paraffin compounds having a carbon number of n+5, C is content of normal paraffin compounds having a carbon number of n; [B/C] is average B/C ratio; and (n) is an integer when total content of normal paraffin compounds having a carbon number of (n) or more account for 3.0 wt % of total content of the normal paraffin compounds in the base fuel), and is incorporated with 0.01 to 0.10 wt % of a FI, reaching the present invention.

The present invention provides a diesel fuel oil composition characterized by base fuel satisfying the relationships $0<A\leqq 4.00$ wt % (wherein A is content, based on all normal paraffin compounds present in the base fuel, of normal paraffin compounds having a carbon number of 20 or more) and $0.04\leqq[B/C]\leqq 0.40$, and being incorporated with 0.01 to 0.10 wt % of a FI.

The present invention, relating to the above diesel fuel oil composition, includes the following preferred embodiments:

(1) the diesel fuel oil composition, wherein a [B/C] ratio is 0.07 to 0.20, (2) the diesel fuel oil composition, wherein content of the FI is 0.03 to 0.07 wt %, and (3) the diesel fuel oil composition of one of (1), wherein the content of the FI is 0.03 to 0.07 wt %.

The present invention is described below in detail. The diesel fuel oil composition of the present invention is characterized by base fuel which contains a specific content of A, has a [B/C] ratio in a specific range, and is incorporated with 0.01 to 0.10 wt % of a FI.

The base fuel for the present invention mainly comprises a mineral oil, having a flash point of 40° C. or higher and 90% distillation temperature of 360° C. or lower. The mineral oil for the present invention is a petroleum fraction, including a petroleum fraction obtained by atmospheric distillation of crude oil, and petroleum fraction obtained by atmospheric or vacuum distillation of crude oil and refined by an adequate process, e.g., hydrogenation, hydrocracking, catalytic cracking and a combination thereof. These petroleum fractions can be used individually or in combination. The base fuel component other than petroleum fraction includes vegetable oil, e.g., soybean, coconut and rape oil, and animal oil, e.g., whale and fish oil.

The diesel fuel oil composition of the present invention satisfies the relationship $0<A\leqq 4.00$ (wt %) (wherein, A is content, based on all normal paraffin compounds present in the base fuel, of normal paraffin compounds having a carbon number of 20 or more). A diesel fuel oil composition may cause engine troubles, e.g., plugging of the fuel passage or fuel filter, when its base fuel contains normal paraffin compounds having a carbon number of 20 or more (hereinafter referred to as ($n\text{-}C_{20}+$)) at above 4.00 wt %, as ambient temperature decreases, because the normal paraffin compounds will separate out.

The diesel fuel oil composition of the present invention also satisfies the relationship $0.04 \leqq [B/C] \leqq 0.40$ (wherein, B is content of normal paraffin compounds having a carbon number of n+5, C is content of normal paraffin compounds having a carbon number of n; [B/C] is average B/C ratio; and (n) is an integer when total content of normal paraffin compounds having a carbon number of (n) or more account for 3.0 wt % of total content of the normal paraffin compounds in the base fuel). Assuming that the normal paraffin compounds having a carbon number of 20 or more accounts for 3.0 wt % of the total normal paraffin components of the base fuel, the average of the $(n\text{-}C_{25})/(n\text{-}C_{20})$, $(n\text{-}C_{26})/(n\text{-}C_{21})$, $(n\text{-}C_{27})/(n\text{-}C_{22})$ . . . ratios consecutively calculated is in a range from 0.04 to 0.40, inclusive. When [B/C] is below 0.04, some of the normal paraffin compounds in the base fuel may separate out as large planar crystals as ambient temperature decreases, even when the relationship $0<A \leqq 4.00$ (wt %) is satisfied, to easily cause plugging of the fuel filter. In other words, such a base fuel has an excessively high CFPP. The similar troubles will occur, when [B/C] exceeds 0.40. [B/C] is preferably in a range from 0.07 to 0.20, inclusive. The base fuel shows a good CFPP, even when ambient temperature decreases, when it satisfies the relationships $0<A \leqq 4.00$ (wt %) and $0.04 \leqq [B/C] \leqq 0.40$, preferably $0.07 \leqq [B/C] \leqq 0.20$.

The component $(n\text{-}C_{20}+)$ of the base fuel for the present invention can be selected from adequate petroleum fractions of different normal paraffin content. These petroleum fractions include petroleum fractions obtained by atmospheric distillation of crudes of different normal paraffin content, and petroleum fractions obtained by atmospheric or vacuum distillation of crude(s) and refined by an adequate process, e.g., solvent dewaxing and catalytic dewaxing. [B/C] of the base fuel can be adjusted by controlling extent of rectification for the distillation operation. [B/C] increases as extent of rectification decreases. The above petroleum fractions can be used individually or in combination to adjust the component $(n\text{-}C_{20}+)$ content and [B/C] levels for the base fuel for the present invention.

The FI useful for the present invention can be selected from the known ones. These include ethylene glycol ester-based compounds, ethylene-vinyl acetate copolymers, ethylene alkylacrylate-based copolymers, chlorinated polyethylene, polyalkyl acrylate, and alkenyl succinamide-based compounds. A FI dosage below 0.01 wt % may not satisfactorily decrease CFPP, and above 0.1 wt % is not economical, because CFPP will not decrease as much as increased dosage. The preferable FI dosage is 0.03 to 0.07 wt %. The above FI's may be used individually or in combination.

The diesel fuel oil composition of the present invention may be incorporated with other known additives for fuel oil, so long as its performance is not damaged. These additives include cetane improver, oxidation inhibitor, metal passivator, detergent, corrosion inhibitor, pour point depressant, de-icer, bactericide, combustion promoter, antistatic agent, lubricity improver, and coloring agent. A general dosage of the additive is 0.1 to 0.5 wt % in the case of pour point depressant, although not limited to this level. One or more of these additives may be used for the present invention, as required.

The diesel fuel oil composition of the present invention may be also incorporated with one or more types of oxygenated compounds so long as its performance is not damaged. These compounds include alcohols, e.g., methanol, ethanol, isopropanol, n-butanol, isobutanol, tert-butanol, amyl alcohol, isoamyl alcohol, n-octanol, 2-ethyl hexanol, n-heptyl alcohol, tridecyl alcohol, cyclohexanol and methyl cyclohexanol; and methyl tert-butyl ether, ethyl tert-butyl ether; dialkyl phthalate, diethylene glycol dimethyl ether and ethyl maleate. A general dosage of the oxygenated compound, e.g., alcohol compound, is 3 to 15 wt %, although not limited to this level.

The present invention is described in more detail by the embodiments presented below, which by no means limit the present invention. The following base fuels, FI's and lubricity improver were used for Examples and Comparative Examples. Measurements of CFPP and $(n\text{-}C_{20}+)$ are also described.

(1) Base Fuel

A total of 17 types of base fuels were used. Their properties are given in Tables 1 and 2.

TABLE 1

| | Base Oil | | | | | | | |
|---|---|---|---|---|---|---|---|---|
| | A | B | C | D | E | F | G | H |
| Density (g/mc$^3$) | 0.8369 | 0.8338 | 0.8248 | 0.8461 | 0.8262 | 0.8457 | 0.8370 | 0.8365 |
| Flash Point (° C.) | 70 | 68 | 69 | 69 | 71 | 75 | 73 | 75 |
| Distillation (° C.) | | | | | | | | |
| Initial boiling point | 176.0 | 182.0 | 161.5 | 224.0 | 180.0 | 215.0 | 208.0 | 216.0 |
| 10% | 222.5 | 220.5 | 212.5 | 260.0 | 221.5 | 257.0 | 248.0 | 254.0 |
| 50% | 287.5 | 279.0 | 279.0 | 294.0 | 274.5 | 292.0 | 287.0 | 287.0 |
| 90% | 346.0 | 345.0 | 342.5 | 340.0 | 328.5 | 336.0 | 334.0 | 330.0 |
| End point | 376.5 | 377.0 | 374.0 | 365.0 | 357.0 | 357.0 | 357.0 | 353.0 |
| Cloud Point (° C.) | −4 | −3 | −4 | −2 | −2 | 0 | 1 | 1 |
| CFPP (° C.) | −5 | −4 | −4 | −3 | −3 | −2 | 0 | −2 |
| Pour point (° C.) | −7.5 | −5 | −7.5 | −2.5 | −2.5 | −2.5 | 0 | 0 |
| $(n\text{-}C_{20}+)$ (wt %) | 2.78 | 3.03 | 2.82 | 3.05 | 4.46 | 3.30 | 3.45 | 3.80 |

TABLE 2

| | Base Oil | | | | | | | | |
|---|---|---|---|---|---|---|---|---|---|
| | I | J | K | L | M | N | O | P | Q |
| Density (g/cm$^3$) | 0.8377 | 0.8350 | 0.8369 | 0.8403 | 0.8425 | 0.8139 | 0.8255 | 0.8355 | 0.8348 |
| Flash Point (° C.) | 70 | 68 | 69 | 69 | 71 | 75 | 73 | 75 | 72 |
| Distillation (° C.) | | | | | | | | | |
| Initial boiling point | 171.0 | 175.0 | 172.0 | 146.5 | 139.0 | 194.5 | 167.0 | 170.0 | 172.5 |
| 10% | 230.5 | 228.5 | 230.0 | 218.0 | 222.0 | 225.0 | 228.0 | 230.0 | 232.5 |
| 50% | 280.0 | 278.5 | 279.5 | 276.0 | 280.0 | 265.5 | 273.0 | 280.0 | 281.5 |
| 90% | 343.0 | 345.5 | 344.0 | 334.0 | 334.5 | 312.0 | 324.0 | 346.0 | 350.0 |
| End Point | 372.0 | 376.0 | 373.0 | 361.5 | 361.0 | 329.0 | 346.0 | 376.0 | 375.0 |
| Cloud Point (° C.) | −2 | −2 | −2 | −1 | −1 | −5 | −4 | −1 | 0 |
| CFPP (° C.) | −3 | −3 | −3 | −3 | −3 | −6 | −5 | −2 | −2 |
| Pour Point (° C.) | −5 | −5 | −5 | −5 | −5 | −7.5 | −5 | −2.5 | −2.5 |
| (n-$C_{20}$+) (wt %) | 1.06 | 0.92 | 1.02 | 3.61 | 3.92 | 0.90 | 1.57 | 3.35 | 4.72 |

(2) FI

An ethylene glycol ester-based FI (ECA9911, produced by Exxon Chemical) and ethylene-vinyl acetate-based FI (PF240, produced by Exxon Chemical) were used.

(3) Measurement of CFPP

CFPP was measured as per JIS K-2288.

(4) Measurement of n-$C_{20}$+

Content of an individual normal paraffin compound in each base fuel was measured by gas chromatography using an analyzer (GC-6AM, produced by Shimadzu), where each sample was passed through a capillary column (inner diameter: 0.25 mm, length: 15 m, impregnated with methyl silicon to a thickness of 0.1 $\mu$m) at 50° C. to 350° C. n-C20+ is defined as total content of normal paraffin compounds having a carbon number of 20 or more.

The base fuel samples shown in Tables 1 and 2 were used to prepare the fuel oil samples shown in Tables 3 and 4, to measure CFPP levels and properties of the base fuels. The results are given in Table 3 for Examples and Table 4 for Comparative Examples.

[B/C] was determined by the following procedure. Content of an individual normal paraffin compound in each base fuel was measured by gas chromatography. Content of the normal paraffin compound having the largest carbon number, and contents of the normal paraffin compounds having smaller carbon numbers are calculated consecutively, where (n) is defined as the integer when total content of normal paraffin compounds having a carbon number of (n) or more account for 3.0 wt % of total content of the normal paraffin compounds in the base fuel. Next, (content of normal paraffin compounds having a carbon number of (n+5))/(content of normal paraffin compounds having a carbon number of (n)) ratios are calculated, and the average is taken as [B/C]. The same gas chromatography as that for measurement of (n-$C_{20}$+) was used.

TABLE 3

| | EXAMPLES | | | | | | | | |
|---|---|---|---|---|---|---|---|---|---|
| | 1 | 2 | 3 | 4 | 5 | 6 | 7 | 8 | 9 |
| Fuel oil compositions (wt %) | | | | | | | | | |
| (a) Base fuel A | 99.96 | | | | | | | | |
| (b) Base fuel B | | 99.96 | | | | | | | |
| (c) Base fuel C | | | 99.96 | | | | | | |
| (d) Base fuel D | | | | 99.96 | | | | | |
| (e) Base fuel I | | | | | 99.98 | | | | |
| (f) Base fuel J | | | | | | 99.98 | | | |
| (g) Base fuel K | | | | | | | 99.98 | | |
| (h) Base fuel L | | | | | | | | 99.98 | |
| (i) Base fuel M | | | | | | | | | 99.98 |
| (j) Dosage of FI | | | | | | | | | |
| • ECA9911 | 0.04 | 0.04 | 0.04 | 0.04 | — | — | — | — | — |
| • PF240 | — | — | — | — | 0.02 | 0.02 | 0.02 | 0.02 | 0.02 |
| Properties of base fuel (n-Paraffins) | | | | | | | | | |
| (a) (n-$C_{20}$+) (wt %) | 2.78 | 3.03 | 2.82 | 3.05 | 1.06 | 0.92 | 1.02 | 3.61 | 3.92 |
| (b) [B/C] | 0.092 | 0.089 | 0.089 | 0.054 | 0.354 | 0.154 | 0.248 | 0.086 | 0.100 |
| CFPP (° C.) | | | | | | | | | |
| (a) Base fuel (incorporated with no FI) | −5 | −4 | −4 | −3 | −3 | −3 | −3 | −3 | −3 |
| (b) Fuel oil (incorporated with an FI) | −16 | −13 | −14 | −9 | −12 | −12 | −12 | −11 | −9 |
| (c) Difference in CFPP [(a) − (b)] | 11 | 9 | 10 | 6 | 9 | 9 | 9 | 8 | 6 |

TABLE 4

| | COMPARATIVE EXAMPLES | | | | | | | |
|---|---|---|---|---|---|---|---|---|
| | 1 | 2 | 3 | 4 | 5 | 6 | 7 | 8 |
| Fuel oil compositions (wt %) | | | | | | | | |
| (a) Base fuel E | 99.96 | | | | | | | |
| (b) Base fuel F | | 99.96 | | | | | | |
| (c) Base fuel G | | | 99.96 | | | | | |
| (d) Base fuel H | | | | 100 | | | | |
| (e) Base fuel N | | | | | 99.98 | | | |
| (f) Base fuel O | | | | | | 99.98 | | |
| (g) Base fuel P | | | | | | | 99.98 | |
| (h) Base fuel Q | | | | | | | | 99.98 |
| (i) Dosage of FI | | | | | | | | |
| • ECA9911 | 0.04 | 0.04 | 0.04 | — | — | — | — | — |
| • PF240 | — | — | — | — | 0.02 | 0.02 | 0.02 | 0.02 |
| Properties of base fuel (n-Paraffins) | | | | | | | | |
| (a) (n-$C_{20}$+) (wt %) | 4.46 | 3.30 | 3.45 | 3.80 | 0.90 | 1.57 | 3.35 | 4.72 |
| (b) [B/C] | 0.027 | 0.035 | 0.434 | 0.045 | 0 | 0 | 0.460 | 0.32 |
| CFPP (° C.) | | | | | | | | |
| (a) Base fuel (incorporated with no FI) | −3 | −2 | 0 | −2 | −6 | −5 | −2 | −2 |
| (b) Fuel oil (incorporated with an FI) | −4 | −3 | 0 | −2 | −7 | −6 | −3 | −3 |
| (c) Difference in CFPP [(a) − (b)] | 1 | 1 | 0 | 0 | 1 | 1 | 1 | 1 |

As shown in Table 3, diesel fuel oil exhibits a notably low CFPP of −9 to −16° C., when it comprises a base fuel which contains a specific content of the component (n-$C_{20}$+), has a [B/C] value in a specific range, and is incorporated with an adequate FI. Its CFPP is significantly lower than that of the base fuel by 6 to 11° C. By contrast, the samples prepared by Comparative Examples, which do not satisfy the relationship with respect to (n-$C_{20}$+) or [B/C], has a CFPP value high and virtually unchanged (or decreased by 0 or 1° C.) from that of the base fuel, even when incorporated with a FI, as shown in Table 4. It is also found that diesel fuel oil shows insufficient CFPP without FI, even when its base fuel contains a specific content of (n-$C_{20}$+) and has a [B/C] value in a specific range. It is therefore essential for a diesel fuel oil composition to comprise a base fuel which contains a specific content of (n-$C_{20}$+), has a [B/C] value in a specific range, and is incorporated with an adequate FI, in order to exhibit good CFPP.

As described above in detail and concretely, the present invention provides a diesel fuel oil composition which exhibits good CFPP by incorporating a base fuel satisfying the relationships $0<(n\text{-}C_{20}+)\leqq 4.00$ (wt %) and $0.04\leqq[B/C]\leqq 0.40$ with an adequate FI.

What is claimed is:

1. A diesel fuel oil composition comprising a base fuel mainly comprising a mineral oil, having a flash point of 40° C. or higher and 90% distillation temperature of 360° C. or lower which satisfies the following relationships (1) and (2), and is incorporated with 0.01 to 0.10 wt % of a flow improver:

(a)

$$0<A\leqq 4.00 \quad (1)$$

wherein, A is content, based on all normal paraffin compounds present in the base fuel, of normal paraffin compounds having a carbon number of 20 or more (wt %), and (b)

$$0.04\leqq[B/C]\leqq 0.40 \quad (2)$$

wherein, B is content of normal paraffin compounds having a carbon number of n+5 (wt %), C is content of normal paraffin compounds having a carbon number of n (wt %); [B/C] is average B/C ratio, and (n) is an integer when total content of normal paraffin compounds having a carbon number of (n) or more account for 3.0 wt % of total content of the normal paraffin compounds in the base fuel.

2. The diesel fuel oil composition of claim 1 wherein the [B/C] ratio is 0.07 to 0.20.

3. The diesel fuel oil composition of claim 1 or 2 wherein the flow improver content is in the range of 0.03 to 0.07 wt %.

* * * * *